US007174665B2

(12) United States Patent
Jay

(10) Patent No.: US 7,174,665 B2
(45) Date of Patent: Feb. 13, 2007

(54) MEDIA DISPLAY SYSTEM FOR SKI-LIFT CHAIR

(76) Inventor: Matthew Jay, 7435 Central Ave., Indianapolis, IN (US) 46240

( * ) Notice: Subject to any disclaimer, the term of this patent is extended or adjusted under 35 U.S.C. 154(b) by 0 days.

(21) Appl. No.: 10/749,545

(22) Filed: Dec. 31, 2003

(65) Prior Publication Data

US 2004/0148834 A1 Aug. 5, 2004

Related U.S. Application Data

(63) Continuation of application No. 09/481,641, filed on Jan. 12, 2000, now abandoned.

(51) Int. Cl.
*A47G 1/06* (2006.01)

(52) U.S. Cl. ..... 40/611.01; 40/320; 40/611.05; 40/661

(58) Field of Classification Search ..... 40/308, 40/320, 611.01, 611.05, 642.02, 650, 651, 40/654.01, 660, 661, 661.12, 665, 666, 727, 40/904, 591, 592, 735, 781; 297/488; D20/19, D20/42

See application file for complete search history.

(56) References Cited

U.S. PATENT DOCUMENTS

| | | | | | |
|---|---|---|---|---|---|
| 2,507 | A | * | 3/1842 | Williams | 100/284 |
| 1,489,113 | A | * | 4/1924 | Brookbank | 40/320 |
| 2,631,468 | A | * | 3/1953 | Thomas | 74/484 R |
| D206,518 | S | * | 12/1966 | Evans | 20/43 |
| 4,094,085 | A | * | 6/1978 | Nolan, Jr. | 40/735 |
| 4,104,818 | A | * | 8/1978 | Hrabik | 40/707 |
| 4,217,711 | A | * | 8/1980 | Spresser et al. | 40/308 |
| 4,291,475 | A | * | 9/1981 | Schoemer | 40/338 |
| 5,301,443 | A | * | 4/1994 | Gori | 40/308 |
| 5,410,827 | A | * | 5/1995 | Smith | 40/1.5 |
| 5,685,095 | A | * | 11/1997 | DeMasi | 40/320 |
| D419,604 | S | * | 1/2000 | Emmett | D20/10 |
| 6,058,638 | A | * | 5/2000 | Sl.ang.ttebrekk | 40/654.01 |

* cited by examiner

*Primary Examiner*—Gary C. Hoge
(74) *Attorney, Agent, or Firm*—Lathrop & Gage LC

(57) ABSTRACT

A display system for displaying media on a ski-lift chair is provided. A main body portion is disclosed, having clamps to hold it to the restraint of the ski-lift chair. A plurality of frames are provided along a top surface of the body portion for holding printable media sheets, such as maps and advertisements, in place. Printable sheets are disclosed as transparent plastic with reverse printed imagery thereon.

22 Claims, 6 Drawing Sheets

MEDIA DISPLAY SYSTEM FOR SKI-LIFT CHAIR

REFERENCE TO RELATED APPLICATIONS

This is a continuation of my prior application, Ser. No. 09/481,641 filed on Jan. 12, 2000 now abandoned.

BACKGROUND OF THE INVENTION

The present invention relates to a media display system for ski-lift chair, and more specifically such a system to be mounted to a lateral restraint along the front side of the chair which retrains people from falling out of the chair.

Skiing is a popular sport enjoyed by many people throughout the world. Ski resorts typically have ski-lifts which include ski-lift chairs having a lateral restraint cross-bar across the front to prevent riders from falling out. As demonstrated by the different U.S. Pat. No. 5,685,095, it is desirable to have a media display system. However, there is a need for a display system which has different and enhanced characteristics of non-rotatability, aerodynamics, interchangeability, ornamentality and/or others. These and other features are provided by various aspects of my novel device.

SUMMARY OF THE INVENTION

The present invention provides a media display system attachable to a lateral restraint along the front side of a ski-lift chair including in combination some or more of the following features as set forth in the claims. A body member is provided which is attachable to a lateral restraint of the ski-lift chair. The body member may be non-rotatable. The body member may have a length in the central region which is greater than the thickness. A frame member may be located on top of the body member with a view of the region therein being adapted to hold printed media, such as ski maps, advertisement or the like.

One object of the present invention is to provide an improved media display system having enhances functional and/or ornamental features.

DESCRIPTION OF THE PREFERRED EMBODIMENTS

Figure 1:
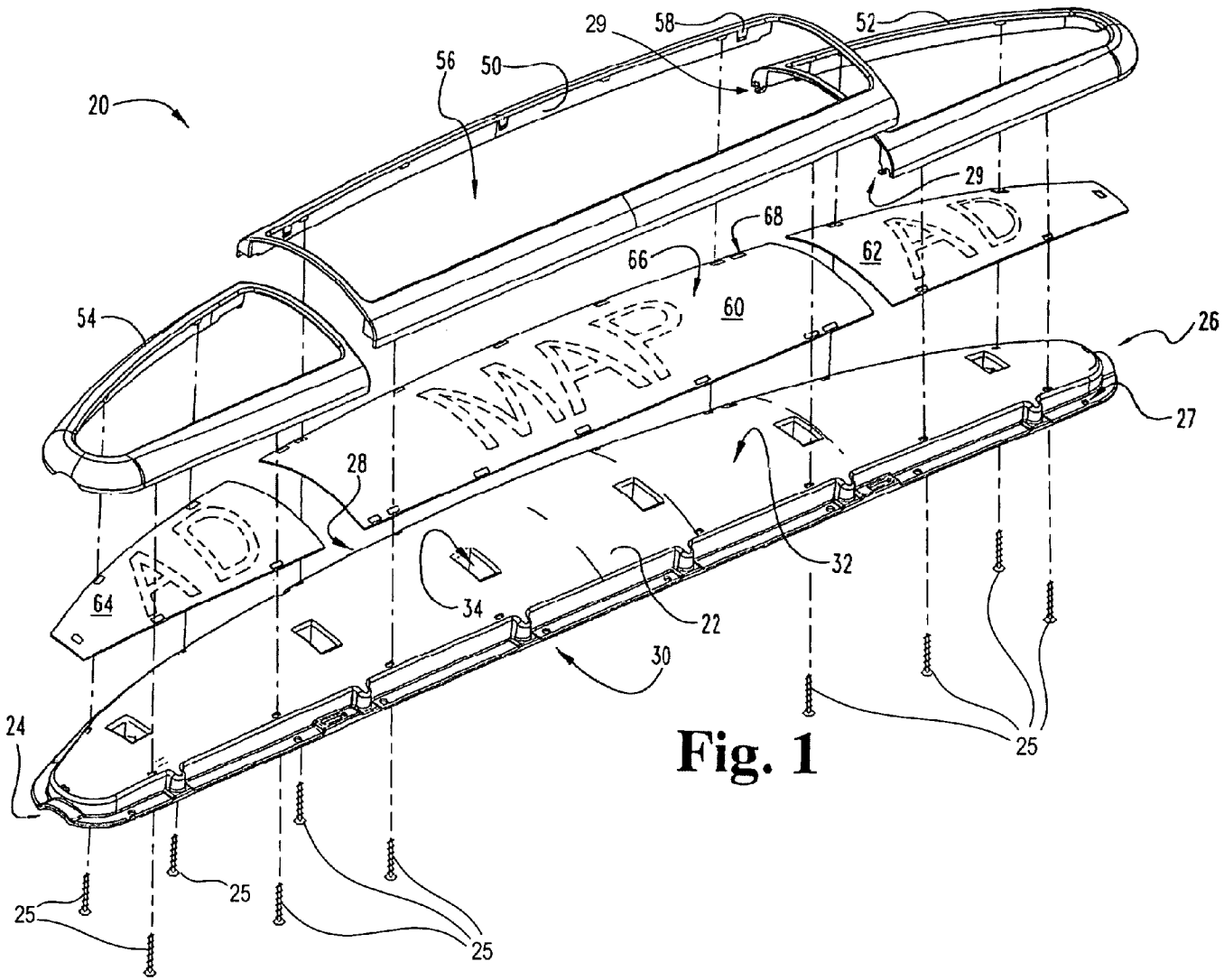
FIG. 1 is an exploded top rear perspective view of a media display system according to one example of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device and method, and further applications of the principles of the invention as illustrated therein are herein contemplated as would normally occur to one skilled in the art to which the invention relates.

One example of the invention is set forth in FIGS. 1–7 as system 20. System 20 includes body member 22. It has a left side 24, a right side 26, a front side 28 and a rear side 30.

One or more frame members are provided, such as central frame member 50, right frame 52 and left frame 54. Preferably, each of these frame members partially or completely encloses a central viewable region, such as viewable region 56 through which printed media may be seen. Such printable media is illustrated in FIG. 1 as "MAP" "AD" for printable media 60, 62 and 64. In the preferred version, each of the printed media has a top side 66 and an opposite side opposite thereto facing downwardly towards body member 22. Preferably, such printed media is protected by a clear plastic film, at least several mils in thickness. Moreover, preferably the imagery is reverse printed in the bottom side of such film. For example, the map lines, trees, and so forth would be reverse printed on the bottom side, and often times printed with the backing color (e.g. white ink). In this way, when the film is mounted between frame 50 and body member 22, the top surface 66 which typically is exposed through viewable region 56 protects the printed ink from scuffing, wear and the like. As illustrated, one approach is to have the three frames, left frame, right frame and central frame. It may be preferable to have a map in the central region showing steep paths and terrain, with advertisements in the other frames. Such advertisements may be sold or leased as a revenue source. Naturally, other combinations may be used, including advertisements in the middle and maps on either side, all advertisements, all maps, or other printed media. It is possible, although not preferred, to have permanently installed printed media. However, it is preferred to have the interchangeable media, sheet 60, 62, and 64, held between the frames and the body member. In this way, the printed media may be changed from time to time by the operator.

Optionally, the printed media, such as sheet 60, may have holes cut therein such as hole opening 68 through which tab 58, which was downwardly projecting, projects. Preferably, such tab may be equipped with a latch tab which snaps into place in a corresponding opening in body member 22 to hold frame 50 in place. As illustrated in FIG. 1, a plurality of tabs, with and without tabs may be provided with corresponding openings punched or otherwise formed in the sheet 60 and other sheets. Such tabs provide registry and maintain the printed media flat, and smooth along the top surface 32 of the body member. Preferably, one or more fasteners, such as screws 25 are screwed through holes, such as hole 27 (see FIG. 1) located in the perimeter flange of body member 22. Only a few screws 25 are shown in FIG. 1, for clarity of illustration. Screws 25 are screwed upwardly into the corresponding frame member to help hold it in place. In the preferred embodiment, the outside frame members may be held in place by only two screws 25 due to the hook coupling in the opposite inboard end of frame 52, said hook being shown in two places at 29 (see FIG. 1, the hooks 29 visible in FIG. 1 are associated with frame 52; other hooks may also be associated with frame 54 but are hidden in the perspective view of FIG. 1).

Figure 5:
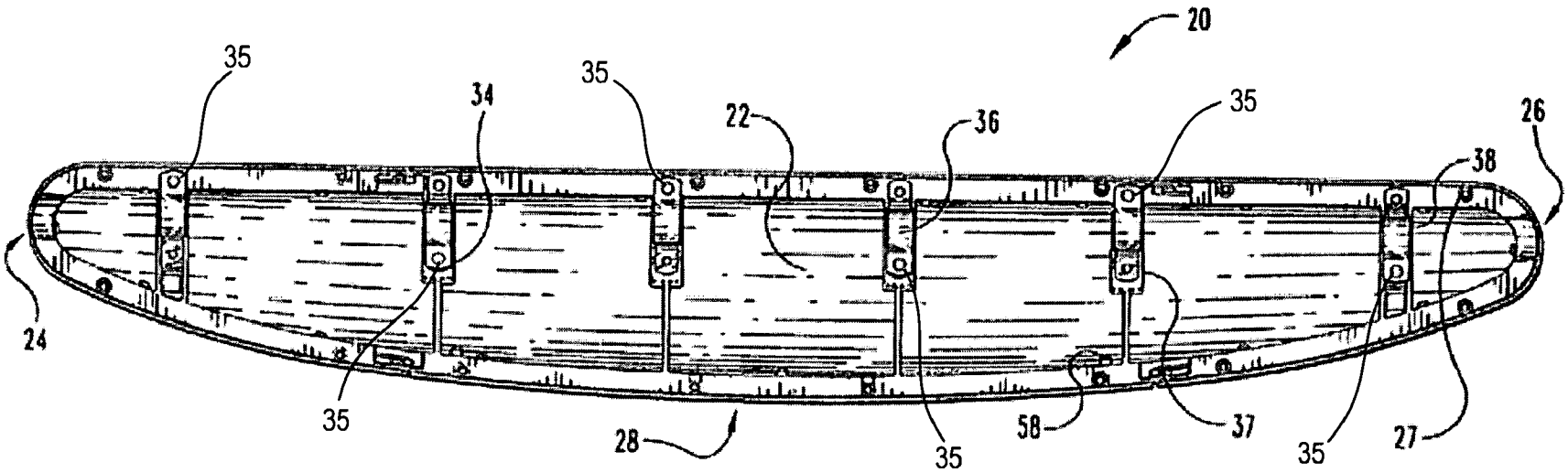
FIG. 5 is a bottom plan view of the device of FIG. 2.
Figure 6:
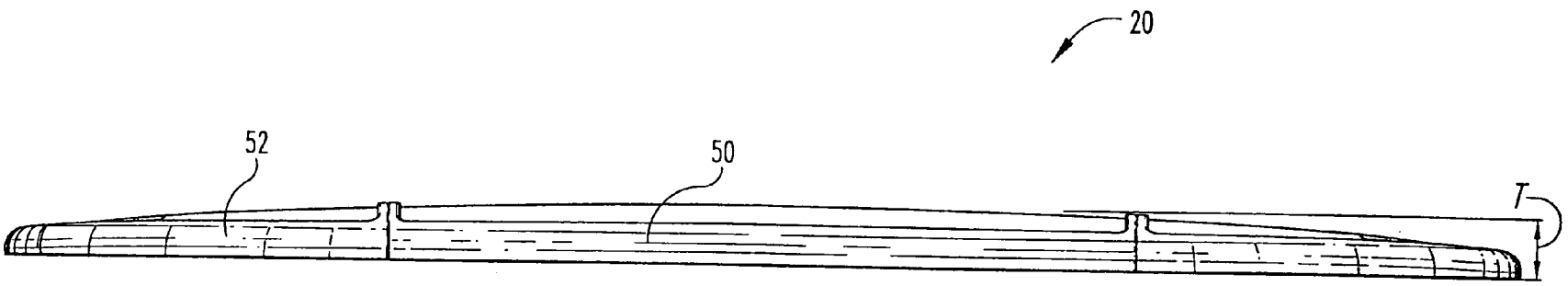
FIG. 6 is a front elevation view of the device of FIG. 2.
Figure 7:
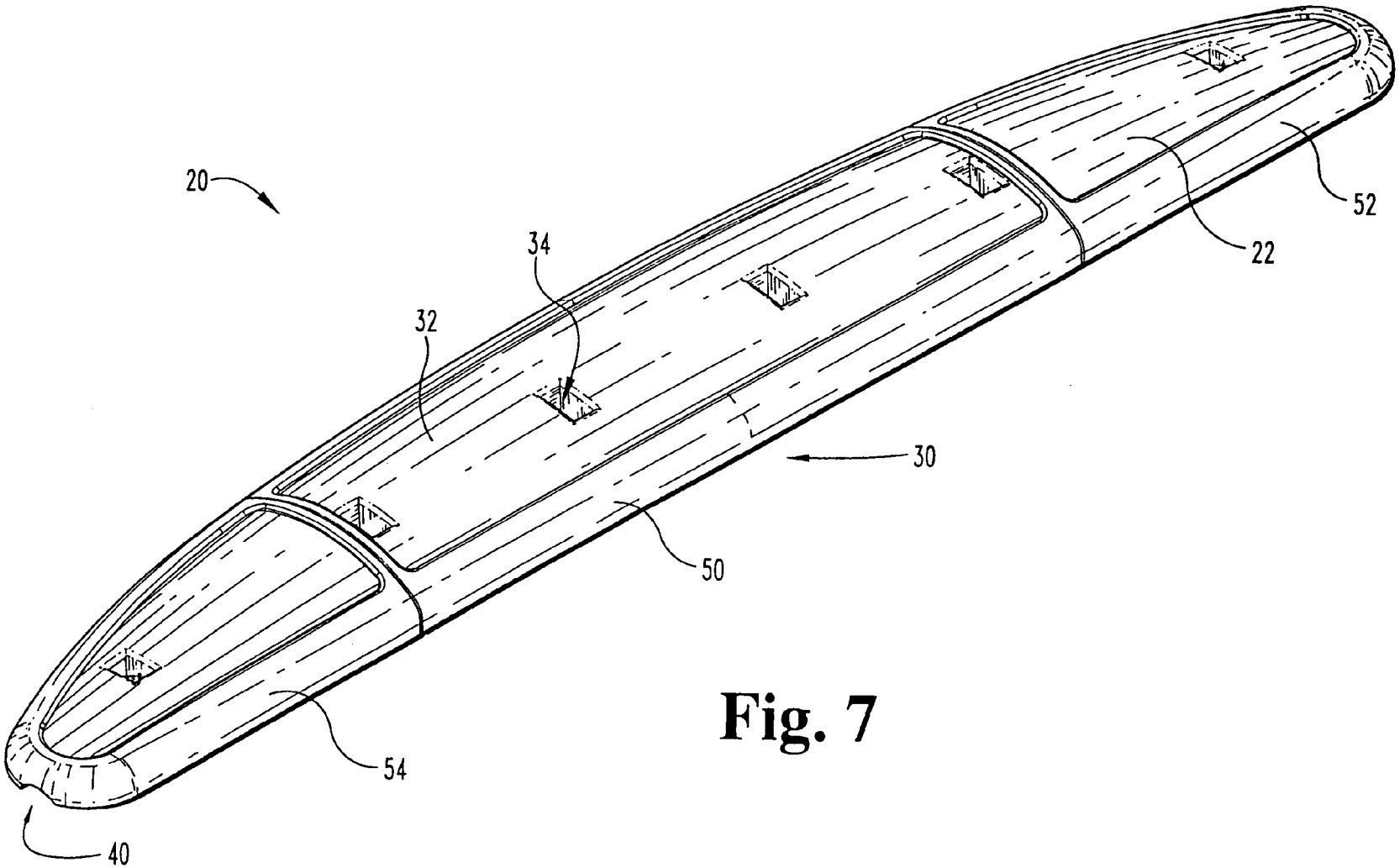
FIG. 7 is a top rear perspective view of the device of FIG. 2.

Optionally, body member 22 may include one or more recesses, such as recess 34, molded therein. Such recesses provide dimensional stiffness in body member 22 as well as providing a bottom surface on which to mount loop members 36, 37 and 38 (see FIG. 5) as well as other loop members as shown. Such loop members preferably are formed from metal strips wrapped in a loop which goes around the lateral restraint of the ski-lift chair. Loops preferably have a top flange and bottom flange projecting tangentially from the circle formed by the loop with the tangent tabs having aligned holes drilled therein. The aligned holes receive a screw 35 through both of the holes. The screw holds the loop, such as loop 34, in place and screw 35 secures into the molded plastic forming body member 22. For example, one of the screws 35 holding loop member 36 in place shown in FIG. 5 is screwed into molded recess 34 of body member 22. Preferably, body member 22 is molded with twin holes on forward side and rearward side of the alignment of the loops. In this way, as illustrated by the staggering position of loop members 36, 37 and 38, the loop members may be oriented with three or more of them such that the flanges and screws 35 holding the loop member in place are offset with each other, forward and reverse or other opposite directions. In this way, the screw holes are in a non-linear arrangement, providing a more stable and secure base to mount the system to the lateral restraint of the chair lift. As the screws 35 are tightened down, the flanges are urged together, cinching the loop members tightly around the restraint, gripping it tightly and preventing it from rotating with respect to the restraint.

Figure 2:
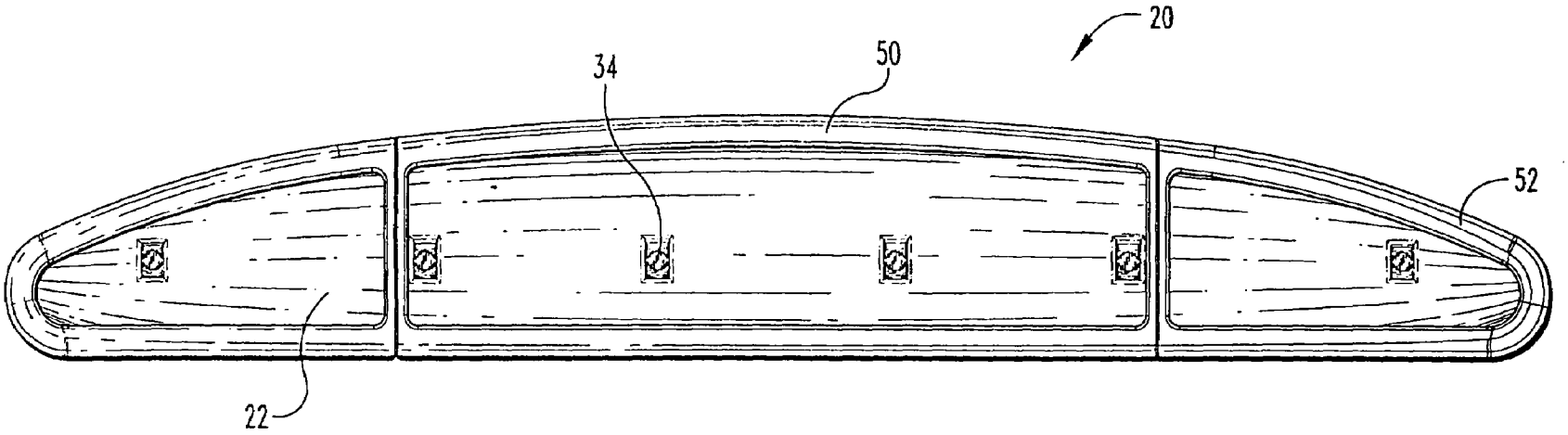
FIG. 2 is a top plan view of one example of the present invention.
Figure 3:
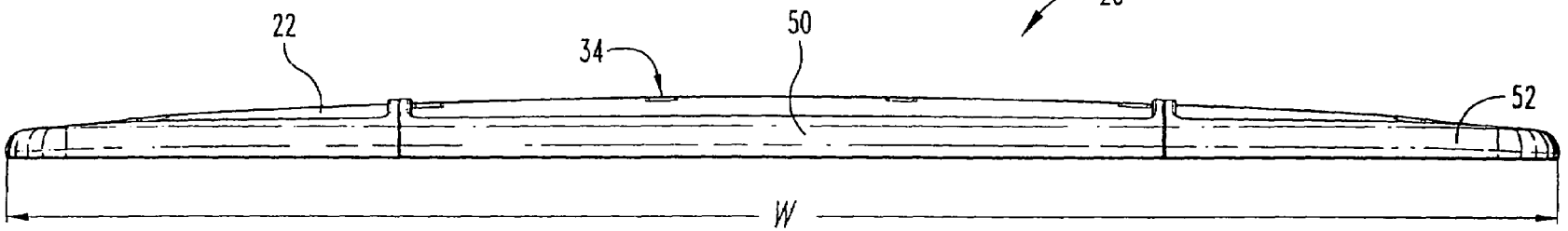
FIG. 3 is a rear elevation view of the device of FIG. 2.
Figure 4:
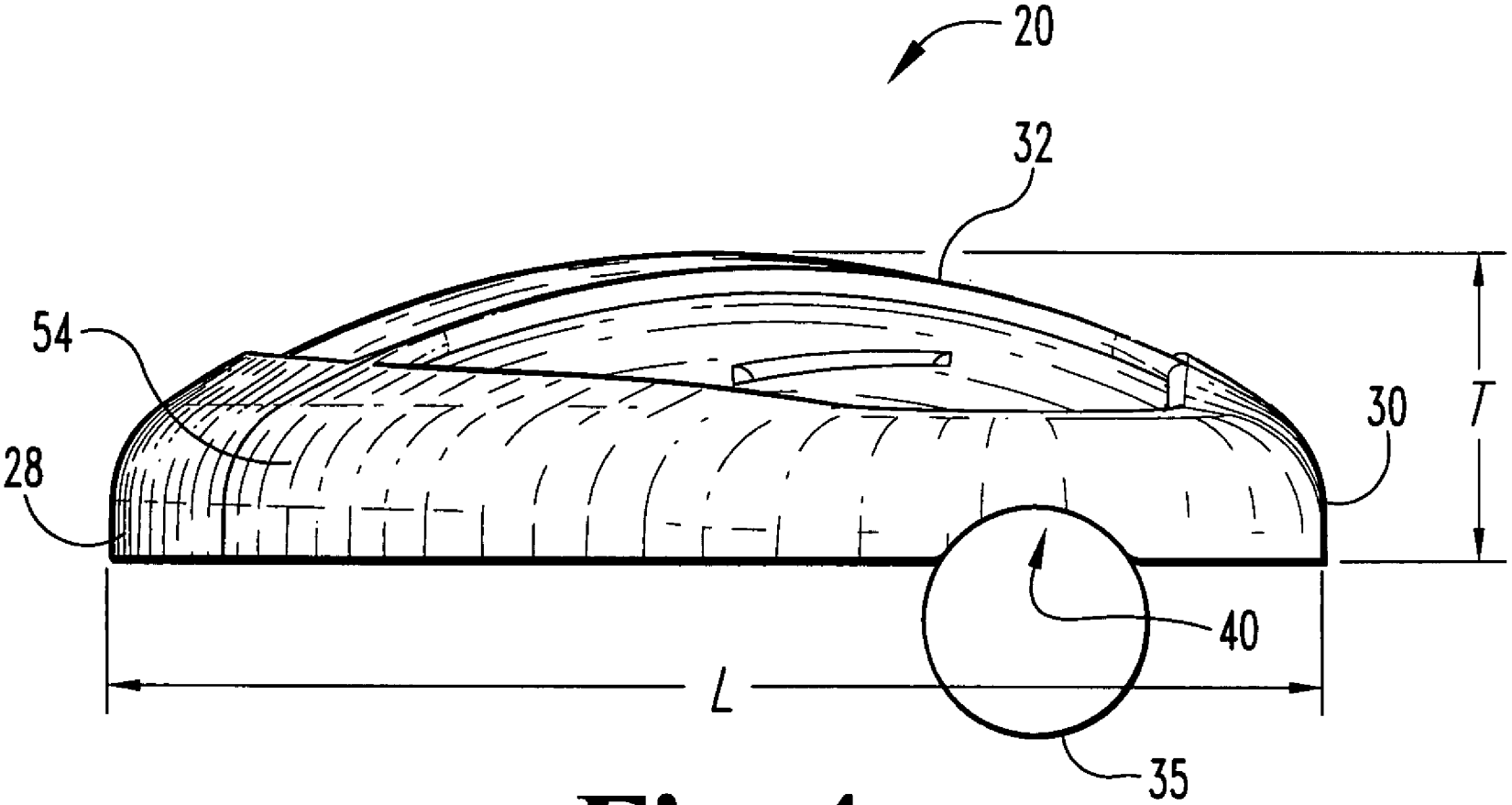
FIG. 4 is a left side elevation view of the device of FIG. 2, the right side elevation view being a mirror image thereof.

Preferably, system 20 has an ornamental appearance which is also aerodynamic. In this regard, one aspect of this is that the length "L" (see FIG. 4) is greater than the thickness "T" of system 20, and preferably is at least two times, and preferably three times greater than thickness "T". Moreover, top surface 32 is preferably convex along the direction of the length from front 28 to rear 30. As illustrated in FIG. 4, semi-cylindrical recess 40 runs along the entire width of system 20 so as to receive the lateral restraint crossbar 35 therein. Note that as shown in FIG. 4, the metal holding clamps looped around the crossbar are removed. As illustrated in FIGS. 2 and 5, the front or leading edge 28 faces forwardly with respect to the ski-lift chair and is swept rearwardly along the width of the leading edge from a central region thereof (i.e. the central ⅓ thereof) to the left and the right sides of body member 22. The extreme right and left tips are rounded when viewed from a plan view.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A media display system for displaying printed media, comprising:

a body member forming a downwardly facing, semi-cylindrical recess along a width of the body member so as to receive a lateral restraint of a ski-lift chair; and at least one frame member that mounts over a top surface of the body member, the at least one frame member forming a viewable region;

the at least one frame member and the body member configured for holding the printed media between the at least one frame member and the body member.

2. System of claim 1, comprising screws that screw upwardly, through holes formed by the body member, into the at least one frame member.

3. System of claim 1, the at least one frame member including a central frame member, a left frame member and a right frame member.

4. System of claim 3, the central frame member forming a width that is about one half of the width of the body member.

5. System of claim 3, each of the left and right frame members (a) forming two hooks that couple with the body member, and (b) being held in place by two screws that screw upwardly, through holes formed by the body member, into the respective frame member.

6. System of claim 3, the left and right frame members each forming a downwardly facing, semi-circular recess to accommodate the lateral restraint.

7. System of claim 1, the at least one frame member comprising downwardly projecting tabs, each tab comprising a latch tab, the body member comprising openings into which the latch tabs snap into place.

8. System of claim 1, the body member and the at least one frame member forming (a) a leading edge that faces forwardly with respect to the ski-lift chair, and (b) right and left sides, the leading edge being swept rearwardly along a width of the leading edge from a center of the leading edge towards the left and right sides.

9. System of claim 8, the top surface being convex along a direction from the leading edge to a rear edge formed by the body member and the at least one frame member.

10. System of claim 1, the body member and the at least one frame member, when integrated together, having a width, a thickness and a length, the thickness being less than one-half of the length.

11. System of claim 10, the thickness being less than one-third of the length.

12. System of claim 10, the width being at least six times the length.

13. System of claim 1, the body member forming molded recesses for securing screws that screw upwardly into the molded recesses, to facilitate attaching the system to the lateral restraint.

14. A media display system for a ski-lift chair, comprising:

a lateral restraint of the ski-lift chair;

a body member forming a downwardly facing, semi-cylindrical recess along a width of the body member, the recess receiving the lateral restraint therein;

at least one frame member that mounts over a top surface of the body member; and printed media held between the at least one frame member and the body member.

15. System of claim 14, the printed media being protected by a clear plastic film that is at least several mils in thickness.

16. System of claim 14, the printed media comprising imagery that is reverse printed on a bottom side of a clear plastic film.

17. System of claim 14, the at least one frame member comprising downwardly projecting tabs, the printed media forming corresponding holes for the tabs.

18. System of claim 14, the at least one frame member including a central frame member, a left frame member and a right frame member.

19. System of claim 14, the body member forming a plurality of molded recesses for securing screws, and screws that screw upwardly into the molded recesses, to facilitate attaching the body member to the lateral restraint.

20. System of claim 19, further comprising (a) at least one loop member having a top flange and a bottom flange that project tangentially from a circle formed by the loop member, the top flange and the bottom flange forming aligned holes such that the loop member encircles the lateral restraint, and (b) a screw passing through the aligned holes into one of the molded recesses.

21. System of claim 19, further comprising a plurality of loop members, each of the loop members having a top flange and a bottom flange that project tangentially from a circle formed by said each loop member, the top flange and the bottom flange forming aligned holes such that said each loop member encircles the lateral restraint, wherein a screw passing through the aligned holes of each loop member attaches to one of the molded recesses.

22. System of claim 19, further comprising:

a plurality of loop members, each of the loop members having a top flange and a bottom flange that project tangentially from a circle formed by said each loop member, the top flange and the bottom flange forming aligned holes such that said each loop member encircles the lateral restraint, the body member forming at least one pair of twin holes, a forward hole of each pair corresponding to each molded recess, a rearward hole of each pair being situated rearward from the semi-circular recess, wherein a screw for each of the loop members may attach to either of the twin holes.

* * * * *

UNITED STATES PATENT AND TRADEMARK OFFICE

CERTIFICATE OF CORRECTION

PATENT NO. : 7,174,665 B2
APPLICATION NO. : 10/749545
DATED : February 13, 2007
INVENTOR(S) : Matthew Jay It is certified that error appears in the above-identified patent and that said Letters Patent is hereby corrected as shown below:

Title page, item (56), line 1, the words "2,507 A * 3/1842" should read --2,507,875 A * 5/1950--; and line 13, "Sl.ang.ttebrekk" should read --Slåttebrekk--

Signed and Sealed this

Fifth Day of June, 2007

JON W. DUDAS
*Director of the United States Patent and Trademark Office*